United States Patent [19]

Siemion

[11] 4,449,267

[45] May 22, 1984

[54] FLOOR SEAL STRIP

[76] Inventor: Edward D. Siemion, 1027 Arlington Ave., Grand Haven, Mich. 49417

[21] Appl. No.: 382,143

[22] Filed: May 26, 1982

[51] Int. Cl.[3] ..... A47L 13/50

[52] U.S. Cl. ..... 15/257 R; 49/70; 49/475; 118/505; 134/42

[58] Field of Search ..... 15/257 R; 118/504, 505; 137/377; 51/262 R, 270, 272, 274, 310; 49/70, 475, 493; 134/6, 38, 42

[56] References Cited

U.S. PATENT DOCUMENTS

| | | | |
|---|---|---|---|
| 3,566,541 | 3/1971 | Coulter | 49/475 |
| 3,633,542 | 1/1972 | Read | 118/505 |
| 3,736,904 | 6/1973 | Kus | 118/505 |
| 4,084,348 | 4/1978 | Hast | 49/475 |
| 4,178,717 | 12/1979 | Sakauye | 49/70 |
| 4,193,375 | 3/1980 | Sharland et al. | 118/504 |
| 4,263,355 | 4/1981 | Sarkisian | 118/505 X |

FOREIGN PATENT DOCUMENTS

| | | | |
|---|---|---|---|
| 520035 | 6/1953 | Belgium | 49/493 |

*Primary Examiner*—Edward L. Roberts

*Attorney, Agent, or Firm*—Price, Heneveld, Huizenga & Cooper

[57] ABSTRACT

A floor seal strip for protecting areas of floor and doorways from the flow of floor care products. A fluid impermeable barrier element has a flat base, from which one side a barrier flange extends upward and in conjunction with a top flange forms a channel in which a fluid absorbtive, deformable sponge is carried with the sponge protruding out from the gap between the top flange and base. A fluid impermeable adhesive strip is attached to the back of the barrier flange, and extends outward from the barrier flange in a direction opposite to the base. In use the seal strip is placed in a doorway with the cushion abutting the bottom edge of the door, and with the adhesive strip adhering the seal strip to the floor.

13 Claims, 6 Drawing Figures

FLOOR SEAL STRIP

BACKGROUND OF THE INVENTION

When stripping wax or other floor finish from tile floors and the like, a very harsh floor finish stripper is used. The harsh stripping properties of such stripers are not confined to floor finishes, but also remove finishes from and damage other objects. Since the stripper is a fluid it will spread across an open area if unconfined, and can easily seep under the gap beneath a closed door. These floor finish strippers have a harmful effect on rugs and carpets and can cause permanent discoloration.

During the application of finish stripper to a tile floor it is necessary to apply the stripper all the way up to entrances of adjoining rooms, some of which may contain carpeting. While stripping the floor in the vicinity of adjoining rooms it is very difficult to prevent the stripper from running under doors into the adjoining rooms and damaging the floor or carpeting in the entranceway. When finish stripper is applied with a machine, such as in industrial applications, the machine has a tendency to splash the stripper up onto doors and other vertical objects. Further, it is sometimes desirable to remove a floor's finish from a particular section of floor not bounded by vertical barriers such as walls or doors. In this situation there are no barriers to confine the floor finish stripper from flowing onto adjacent floor areas and removing the finish from those sections of floor.

SUMMARY OF THE INVENTION

Accordingly, the present invention provides a device which prevents the flow of floor finish stripping agents onto sections of floor to be protected. The present invention also provides a device which protects vertical objects, and more specifically doors, from being splashed with a floor stripping agent during the application of the stripper to a floor.

The present invention provides a floor seal strip which can be placed on a floor abutting the lower edge of a door, thereby blocking the gap underneath this door against the flow of a floor stripping agent. The seal strip has a flat base which allows for contact of the seal strip with the floor all along its length and has thereon a channel in which is carried a spongy material. A strip of adhesive material is attached to the side of the strip opposite the spongy material and is used to affix the seal strip to the floor.

The seal strip is placed in abutment with a door, with the base projecting into the gap between the door and the floor. The spongy material forms a seal against the door and the adhesive material holds the seal strip in place. When a stripper is applied to the floor the seal strip provides a barrier against the flow of the stripping agent and further protects against splashing of the stripper by a machine applicator. In the event that some of the stripper does splash over the seal strip, the spongy material abutting the doorway will absorb the stripper and thereby protect the door.

The floor seal strip can also be used in open areas to prevent the stripping agent from flowing out across areas of floor which are desired not to be treated. Further, when the device is used in abutment with a door or the like, the seal strip prevents against the scuffing and scratching of the door by a machine applicator, since the seal strip prevents contact and the spongy material helps to absorb these impacts.

DETAILED DESCRIPTION OF THE PREFERRED EMBODIMENT

Figure 1:
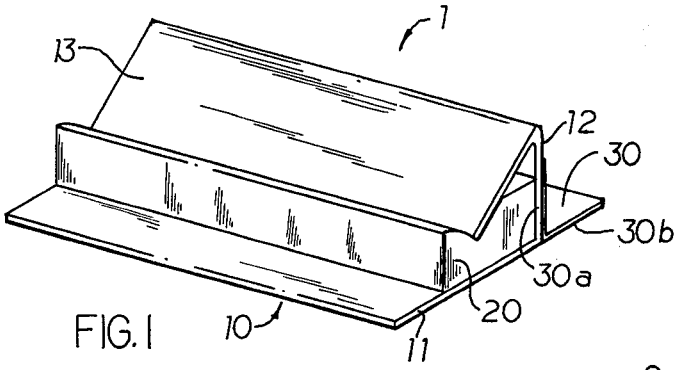
FIG. 1 is a front perspective view of a seal strip embodying the present invention.
Figure 2:
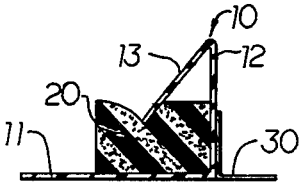
FIG. 2 is a side, sectional view of the seal strip of FIG. 1.
Figure 3:
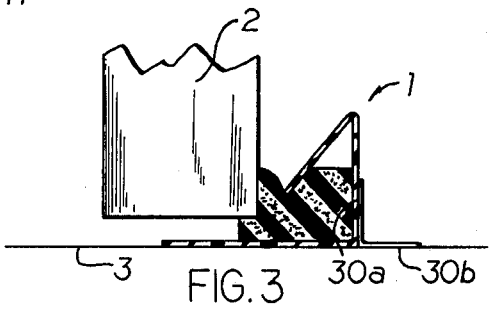
FIG. 3 is a side, elevational view of a seal strip of the present invention in abutment of the lower edge of a door.
Figure 4:
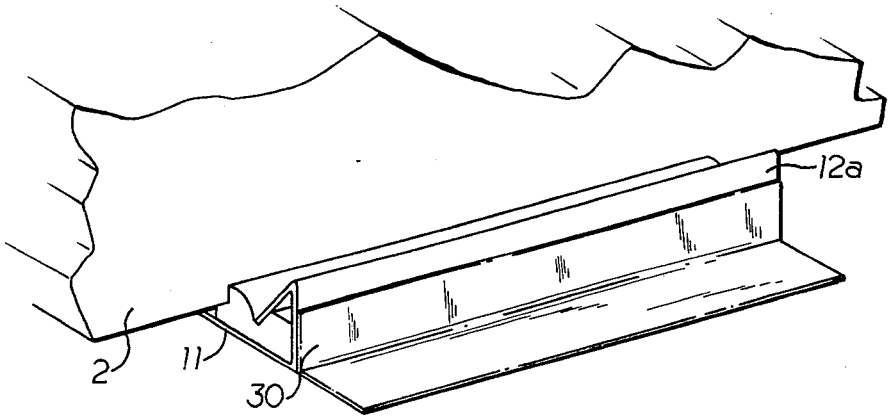
FIG. 4 is a back perspective view of a section of seal strip in abutment with the lower edge of a door.
Figure 6:
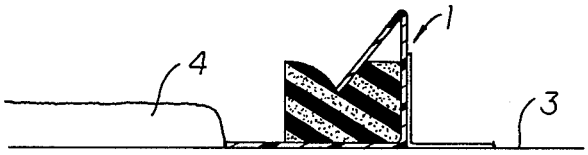
FIG. 6 is a side, elevational view of a seal strip taken along the plane VI—VI of FIG. 5.
Figure 5:
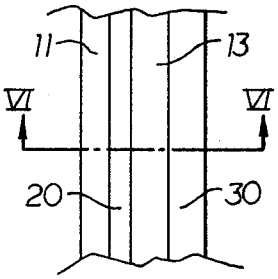
FIG. 5 is a plan view of the seal strip mounted at the boundary between a carpeted area and a tile area.

The present invention relates to a sealing strip 1 which is used to block the flow of floor finish stripping fluids onto areas of floor which are not desired to be treated. The sealing strip 1 includes a fluid impermeable barrier strip 10 or channel element 10 which carries a strip of compressible cushion material 20. When in use the sealing strip 1 is placed against the bottom edge of a door, as shown in FIG. 3, so that cushion 20 abuts the door 2. Adhesive strip 30 affixes barrier strip 10 to the floor to hold the sealing strip in place and prevent fluid from passing underneath the sealing strip 1.

Sealing strip 1 includes a barrier or channel element 10, deformable strip 20 and adhesive strip 30. Barrier element 10 comprises a base flange 11 having a flat lower surface to provide contact with a floor all along its length. Extending upward from one side of base flange 11 is a barrier flange 12, which extends upward approximately ½ inch. Extending outward from the top of barrier flange 12 is top flange 13, which extends from the same side of barrier flange 12 as base flange 11 extends. Top flange 13 angles downward from barrier flange 12 to form an angle of less than 90 degrees with flange 12. Flanges 11, 12 and 13 therefore define a channel having an opening defined by the free end of top flange 13 and the area of base flange 11 beneath the free end of top flange 13. Since top flange 13 is angled downward this gap is less than the height of flange 12. Base flange 11 extends laterally from barrier flange 12 a distance greater than the distance top flange 13 extends laterally from flange 12. Barrier strip 10 is formed by forming a fluid impermeable strip of plastic of the desired length into the above configuration.

Cushion 20 is a strip of deformable sponge material having a rectangular cross section. The sponge strip 20 is the same length as barrier strip 10 and has a height slightly greater than the gap defined by the free end of flange 13 and flange 11. Sponge strip or cushion 20 is received and carried within the channel defined by flanges 11, 12 and 13. The width of sponge 20 is greater than the distance top flange 13 extends laterally from flange 12 so that a portion of sponge 20 protrudes out through the gap defined by the free end of flange 13 and flange 11, cushion 20 is located in abutment with barrier flange 12. Since the height of sponge 20 is greater than the gap between flanges 13 and 11, sponge 20 is deformed downward slightly by top flange 13 and thereby held in the channel of barrier strip 10. Base flange 11 is of sufficient width that it extends further from flange 12 than sponge 20 extends from flange 12. Sponge 20 is cut from a fluid absorbtive material which can be resiliently deformed.

Attached to the back 12*a* of flange 12 is a fluid impermeable, flexible adhesive strip 30 having sticky adhesive surfaces 30*a* and 30*b*. Adhesive strip 30 is bent so as to protrude outward from flange 12 in the same plane but in a direction opposite to base flange 11. Adhesive strip 30 is a strip of plastic tape which is adhered to flange 12 and will adhere to floors. It runs the length of barricade strip 10.

OPERATION

With the above detailed description and drawings the operation of the present invention can be understood.

Before application of floor finish stripper to a floor, a floor seal strip 1 of a length equal to a doorway to be protected is placed on the floor in abutment with the door. The free end of base flange 11 is slid through the gap defined by the bottom of the door 2 and the floor 3 until cushion 20 abuts door 2 along its entire length. Sponge 20 is compressed slightly as shown in FIG. 3, and if pressed further against door 2 sponge 20 will be compressed up into the channel defined by flanges 11, 12 and 13. This prevents irregularities in the manufacture of sponge 20 from interfering with the operation of seal strip 1. When so positioned adhesive strip 30 is pressed against floor 3 to maintain floor seal strip 1 in the desired position, and also to prevent stripping fluid from flowing underneath floor seal 1 and onto the area to be protected.

As floor finish stripping fluid is applied to floor 3, floor seal 1 prevents the fluid from flowing out onto the protected area of floor. Barrier flange 12 prevents the stripping fluid from being splashed up onto door 2. In the event that some stripping fluid does accidentally flow over the top of barrier flange 12, the absorbtive sponge 20 will absorb the fluid as it runs down top flange 13 and thus prevent the fluid from contacting door 2.

Since cushion 20 is elastically deformable, seal strip 1 will prevent a machine applicator from striking door 2 and allow cushion 20 to absorb the impact, thereby preventing maring or scratching of door 2. Additionally, since base flange 11 extends out past cushion 20, when pressure is applied to barrier flange 12 base flange 11 prevents the seal strip from pivoting and tipping over.

Seal strip 1 can be used to protect other objects, carpet 4 or other floor areas from damage by floor finish stripper by surrounding the object to be protected with sections of seal strip 1 and maintaining the sections in position with adhesive strip 30 as described above.

It is understood that the above is the preferred embodiment of the invention and that various changes and alterations can be made without departing from the spirit and broader aspects of the invention as defined by the claims set forth below and by the range of equivalency allowed by law.

The embodiments of the invention in which an exclusive property or privilege is claimed or defined as follows:

1. A floor sealing strip, comprising:

a fluid impermeable base element;

a fluid impermeable barrier element connected to and extending upward from said base element;

means for affixing the sealing strip to a floor, said affixing means barring fluid communication between said base element and the floor beneath said base element when said base element is in a position of use, said affixing means extending from said barrier element in the same plane as said base element in a direction opposite said base element;

a cushion element in abutment with said barrier element and which extends laterally from said barrier element and extends above said base element;

whereby said sealing strip when in a position of use prevents the flow of fluid past said sealing strip, and when said sealing strip is placed in a position of use abutting a door, said cushion element abuts said door.

2. A floor sealing strip, comprising:

a fluid immpermeable base element;

a fluid impermeable barrier element connected to and extending upward from said base element;

means for affixing the sealing strip to the floor, said affixing means barring fluid communication between said base element and the floor beneath said base element when said base element is in a position of use;

a cushion element in abutment with said barrier element and which extends laterally from said barrier element and extends above said base element, said base element extending laterally from said barrier element a distance greater than said cushion element extends from said barrier element, said base element having a height substantially less than the gap normally defined by a door and floor, and said cushion element having a vertical abutment surface extending above said base element, said abutment surface having portions at a height greater than the gap normally defined by a door and floor, whereby said sealing strip when in a position of use preventing the flow of fluid past said sealing strip, and when said sealing strip is placed in a position of use abutting a door, said cushion element abutment surface abuts the side of the door along the length of the door lower edge, and when said strip is in a position of use and pressure is applied to the back of said barrier element said base element extends into said gap between the door and floor and assists in preventing said sealing strip from tipping.

3. A sealing strip as described in claim 2 wherein, said affixing means is a fluid impermeable, adhesive strip affixed to said sealing strip and extending from said sealing strip in the same plane as said base element.

4. A sealing strip as described in claim 3 wherein said cushion element is a fluid absorbing sponge.

5. A sealing strip as described in claim 4 having a top flange extending from said barrier element forming an angle with said barrier element of less than 90 degrees, said top flange extending from the same side of said barrier element as said base element extends from, so that said base element, barrier element and top flange define a channel having a gap between the free end of said top flange and the area of said base element beneath the free end of said top flange, said channel receiving said cushion element and a portion of said cushion element protruding through the gap defined by said top flange and base element.

6. A sealing strip as defined in claim 3, having a top flange extending from said barrier element forming an angle with said barrier element of less than 90 degrees, said top flange extending from the same side of said barrier element as said base element extends from, so that said base element, barrier element and top flange define a channel having a gap between the free end of said top flange and the area of said base element beneath the free end of said top flange, said channel receiving said cushion element and a portion of said cushion element protruding through the gap defined by said top flange and base element.

7. A sealing strip as described in claim 1 or 2, wherein said cushion element is a fluid absorbing sponge.

8. A sealing strip as described in claim 7, having a top flange extending from said barrier element forming an angle with said barrier element of less than 90 degrees, said top flange extending from the same side of said barrier element as said base element extends from, so that said base element, barrier element and top flange define a channel having a gap between the free end of said top flange and the area of said base element beneath the free end of said top flange, said channel receiving said cushion element and a portion of said cushion element protruding through the gap defined by said top flange and base element.

9. A sealing strip as described in claim 1 or 2 having a top flange extending from said barrier element forming an angle with said barrier element of less than 90 degrees, said top flange extending from the same side of said barrier element as said base element extends from, so that said base element, barrier element and top flange define a channel having a gap between the free end of said top flange and the area of said base element beneath the free end of said top flange, said channel receiving said cushion element and a portion of said cushion element protruding through the gap defined by said top flange and base element.

10. A method of use of a floor sealing strip comprising:

providing a floor sealing strip having a fluid impermeable base element, a fluid impermeable barrier element connected to and extending upward from said base element, affixing means for barring fluid communication between said base element and the floor beneath said base element when said base element is in a position of use, a cushion element in abutment with said barrier element and which extends laterally from said barrier element and extends above said base element, said strip having a length equal to the length of the section of floor to be protected;

placing said floor sealing strip in abutment with the edge of the floor section to be protected;

affixing said floor sealing strip to the floor by means of said affixing means;

applying a liquid floor care product to the section of floor to be treated.

11. The method of use described in claim 10, wherein said floor sealing strip provided further comprises a top flange extending from said barrier element forming an angle with said barrier element of less than 90 degrees, said top flange extending from the same side of said barrier element as said base element extends from, so that said base element, barrier element and top flange define a channel having a gap between the free end of said top flange and the area of said base element beneath the free end of said top flange, said channel receiving said cushion element and a portion of said cushion element protruding through the gap defined by said top flange and base element, said base element extending laterally from said barrier element a distance greater than said cushion element extends from said barrier element; and said cushion is a fluid absorbing sponge.

12. A method of use of a floor sealing strip comprising:

providing a floor sealing strip having a fluid impermeable base element, a fluid impermeable barrier element connected to and extending upward from said base element, means for affixing the sealing strip to a floor, said affixing means barring fluid communication between said base element and the floor beneath said base element when said base element is in a position of use, said strip having a length equal to the length of the section of floor to be protected, and having a fluid absorbent element in abutment with said barrier element and which extends laterally from said barrier element and extends above said base element;

placing said floor sealing strip in abutment with the edge of the floor section to be protected;

affixing said floor sealing strip to the floor by means of said affixing means;

applying a liquid floor care product to the section of floor to be treated.

13. A floor sealing strip, comprising:

a fluid impermeable base element;

a fluid impermeable barrier element connected to and extending upward from said base element;

means for affixing the sealing strip to a floor, said affixing means barring fluid communication between said base element and the floor beneath said base element when said base element is in a position of use;

and a fluid absorbent element in abutment with said barrier element and which extends laterally from said barrier element and extends above said base element;

whereby when said sealing strip is in a position of use said barrier element provides a barrier to the flow of fluid past said sealing strip, and said fluid absorbent element will absorb fluid that may flow over said barrier.

* * * * *